United States Patent [19]

Spanke et al.

[11] 4,150,618

[45] Apr. 24, 1979

[54] PRESS HAVING SLIDE SHUT HEIGHT ADJUSTING AND LOCKING MECHANISM

[75] Inventors: Edwin A. Spanke, Oak Forest; Louis F. Carrieri, LaGrange Park, both of Ill.

[73] Assignee: Gulf & Western Manufacturing Company, Southfield, Mich.

[21] Appl. No.: 856,015

[22] Filed: Nov. 30, 1977

[51] Int. Cl.[2] ..... B30B 1/06

[52] U.S. Cl. ..... 100/257; 74/44; 151/15

[58] Field of Search ..... 100/257; 151/15; 74/44, 74/586

[56] References Cited

U.S. PATENT DOCUMENTS

| | | | |
|---|---|---|---|
| 1,749,398 | 3/1930 | Strout | 100/257 X |
| 1,788,071 | 1/1931 | Strout | 74/44 |
| 2,198,333 | 4/1940 | Freeman | 100/257 |
| 2,608,253 | 8/1952 | Battles | 100/257 |
| 2,706,525 | 4/1955 | Ruppert | 100/257 |
| 2,984,175 | 5/1961 | Wahl | 100/257 |
| 3,133,494 | 5/1964 | Hecht | 100/257 |

*Primary Examiner*—Billy J. Wilhite

*Attorney, Agent, or Firm*—Meyer, Tilberry & Body

[57] ABSTRACT

The reciprocating slide of a mechanically driven press has a ball and socket type interconnection with the connecting rod of the press drive mechanism. The socket component of the interconnection provides a rotatable adjusting screw by which the shut height of the slide is adjustable, and a locking nut threadedly engages the adjusting screw and is rotatable relative thereto and to the slide to lock the adjusting screw against displacement relative to the slide during operation of the press.

16 Claims, 5 Drawing Figures

PRESS HAVING SLIDE SHUT HEIGHT ADJUSTING AND LOCKING MECHANISM

The present invention relates to the art of presses and, more particularly, to a press having an improved slide shut height adjusting and locking mechanism.

In the art of mechanical presses, it is of course known to pivotally interconnect the connecting rod of a press drive mechanism with the press slide by a ball and socket type interconnection and to provide for the component parts interconnecting the connecting rod and slide to be adjustable to enable adjustment of the shut height of the slide relative to the press bed. The adjusting mechanism generally includes relatively rotatable threadedly interengaged members one of which is associated with the connecting rod and the other of which is associated with the slide. Rotation of one of the elements relative to the other imparts displacement to the slide relative to the connecting rod and thus to the press bed. Locking arrangements are provided in conjunction with the adjusting mechanism to lock the rotatable elements against relative displacement. The intended purpose of such locking arrangements is to maintain the desired shut height for the slide during operation of the press and the resultant impact loads and forces imposed on the adjusting mechanism by engagement of tooling carried by the slide with a workpiece supported on tooling mounted on the press bed. Further in connection with such adjusting mechanisms and locking arrangements therefor, it is desirable to obtain maximum slide adjustment capability relative to the press bed, ease of adjustment of the shut height, and a locking arrangement which optimizes maintaining a given shut height during operation of the press.

The present invention provides a shut height adjusting mechanism and locking arrangement by which the foregoing advantages are achieved in connection with a ball and socket type interconnection between the slide and connecting rod of the press drive mechanism. More particularly in accordance with the present invention, one member of the ball and socket interconnection is an adjusting screw member threadedly engaged with the slide and axially fixed with respect to the connecting rod. The adjusting screw member is rotatable relative to the slide through the threaded engagement therewith and is rotatable relative to the connecting rod through the ball and socket interconnection. Accordingly, it will be appreciated that rotation of the adjusting screw member imparts displacement to the slide relative to the connecting rod and thus the press bed.

Additionally, the slide carries a locking nut member surrounding the threads on the adjustment screw and which locking nut member is rotatable relative to the adjusting screw and the slide. The locking nut member and the slide have axially opposed abutment surfaces, and the locking nut is rotated relative to the slide to bring the abutment surfaces into engagement to impose an axial force on the adjusting screw which locks the latter against rotation relative to the slide and connecting rod. Such application of axial force on the adjusting screw preferably preloads the screw in the direction of the driving force of the slide, thus removing all backlash in the adjustment screw. Preferably, rotation of the locking nut in the direction to release the adjusting screw for rotation is limited, and the locking nut is supported by the slide in a manner whereby the adjusting screw is rotatable relative to the nut and to the slide to achieve adjustment of the shut height. Limited rotation of the locking nut in the direction to release the adjusting screw assures a running thread clearance therebetween so that the adjusting screw can be freely rotated relative to the nut.

In addition to more effectively maintaining the slide in an adjusted position against displacement during operation of the press, in comparision to previous adjusting and locking arrangements, the adjusting and locking arrangement of the present invention enables maintaining optimum slide adjustment capabilities, in other words a desirable length of available slide adjustment relative to the connecting rod of the press drive mechanism. Still further, the mechanism is economical to manufacture and install, is compact, and is simple to operate and thus enables adjustment and locking to be quickly achieved.

It is accordingly an outstanding object of the present invention to provide an improved slide shut height adjusting and locking mechanism for a press having a ball and socket type interconnection between the slide and connecting rod of the press drive mechanism.

Another object is the provision of a slide adjusting and locking mechanism of the foregoing character which includes an adjusting screw member for achieving shut height adjustment and a locking nut member interengaging the adjusting screw member and slide to lock the adjusting screw member against displacement relative to the slide.

Still another object is the provision of a slide adjusting and locking mechanism of the foregoing character in which the locking nut member interengages the adjusting screw and slide to preload the adjusting screw in the direction of the driving force on the slide.

A further object is the provision of a slide adjusting and locking mechanism of the foregoing character which is inexpensive to manufacture and install, which is more efficient in maintaining slide adjustment than arrangements heretofore provided, which facilitates achieving slide adjustment with relative ease, and which enables maintaining optimum adjustment capability of the slide relative to the connecting rod of the press drive mechanism.

The foregoing objects, and others, will in part be obvious and in part pointed out more fully hereinafter in conjunction with the written description of a preferred embodiment shown in the accompanying drawings in which.

Figure 1:
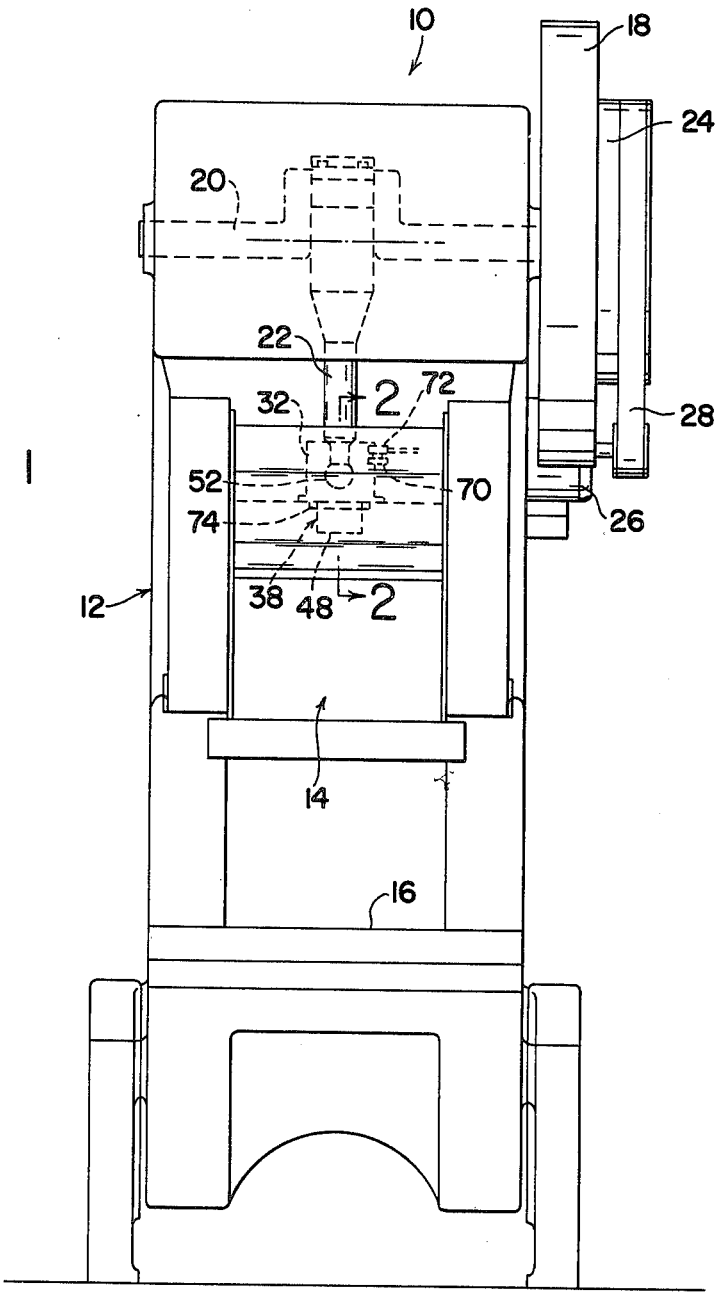
FIG. 1 is a front elevation view of a press incorporating the slide adjusting and locking arrangement in accordance with the present invention.

Referring now in greater detail to the drawings wherein the showings are for the purpose of illustrating a preferred embodiment of the invention only and not for the purpose of limiting the invention, FIG. 1 illustrates a press 10 having a frame 12 which supports a slide 14 for reciprocating movement toward and away from press bed 16. The press further includes a flywheel 18 attached to one end of a crankshaft 20 which is interconnected with slide 14 by a connecting rod 22, whereby rotation of crankshaft 20 imparts reciprocating movement to slide 14. In the embodiment shown, flywheel 18 is driven through a brake-clutch unit 24 by means of a drive motor 26 and a drive belt 28 interconnecting the motor and brake-clutch unit.

Figure 2:
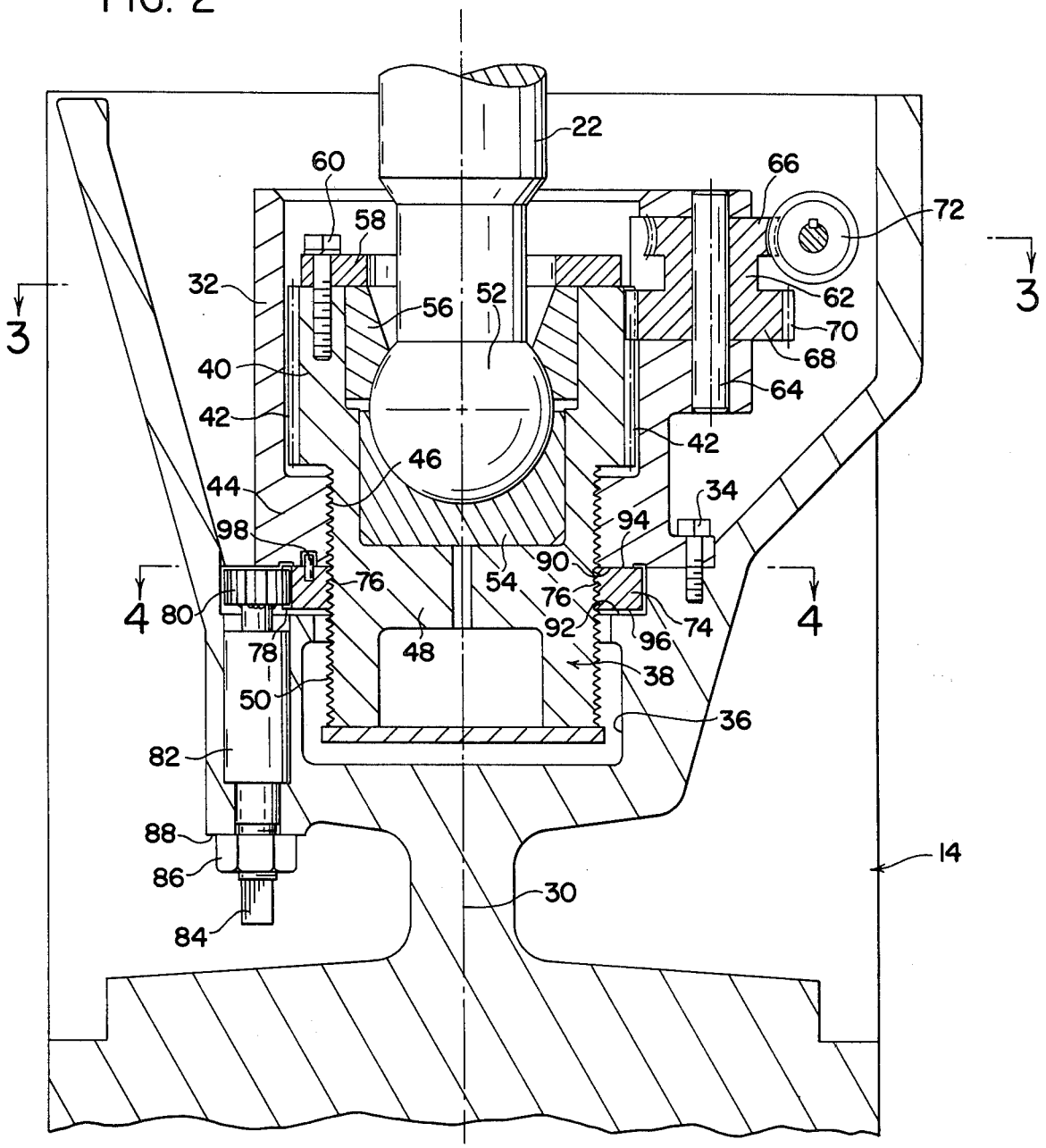
FIG. 2 is a sectional elevation view of the slide taken along line 2—2 in FIG. 1 and showing the slide adjusting and locking mechanism in detail.
Figure 3:
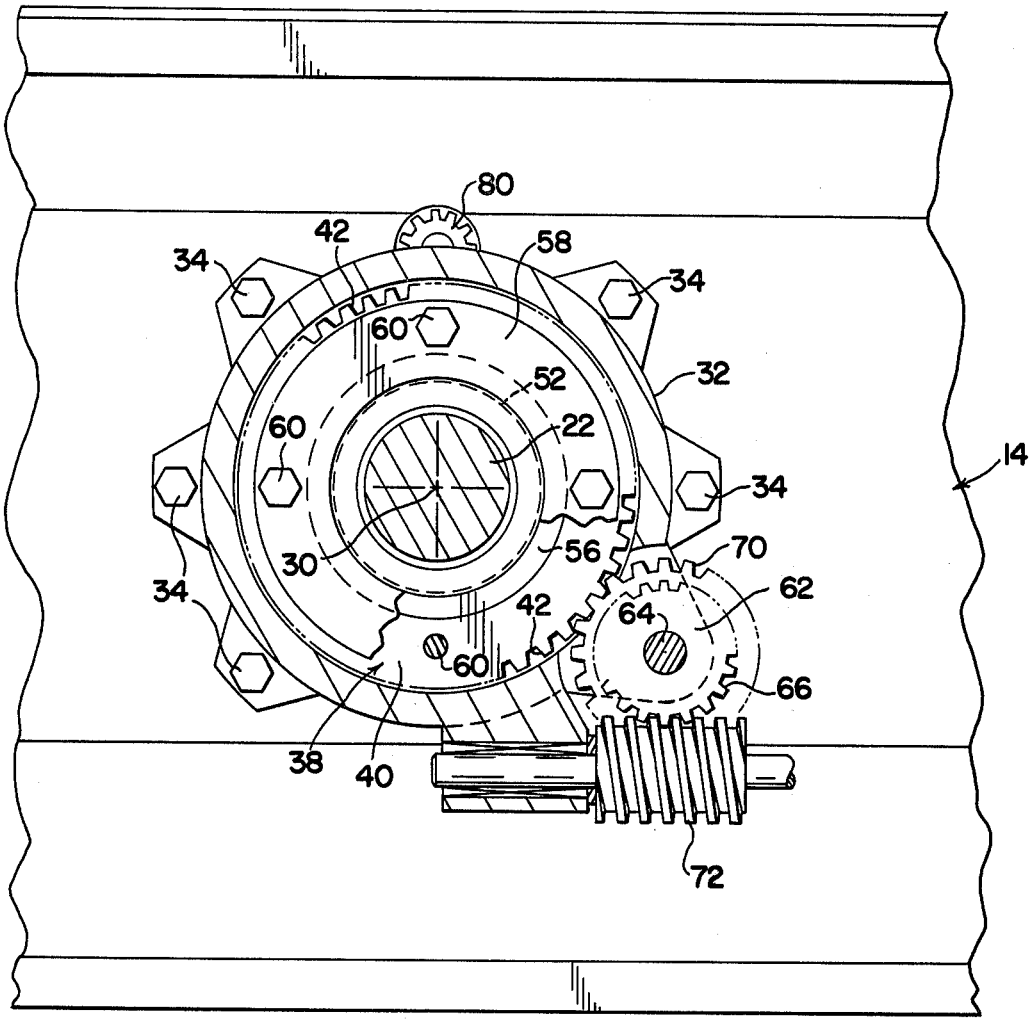
FIG. 3 is a cross-sectional view of the mechanism taken along line 3—3 in FIG. 2.
Figure 4:
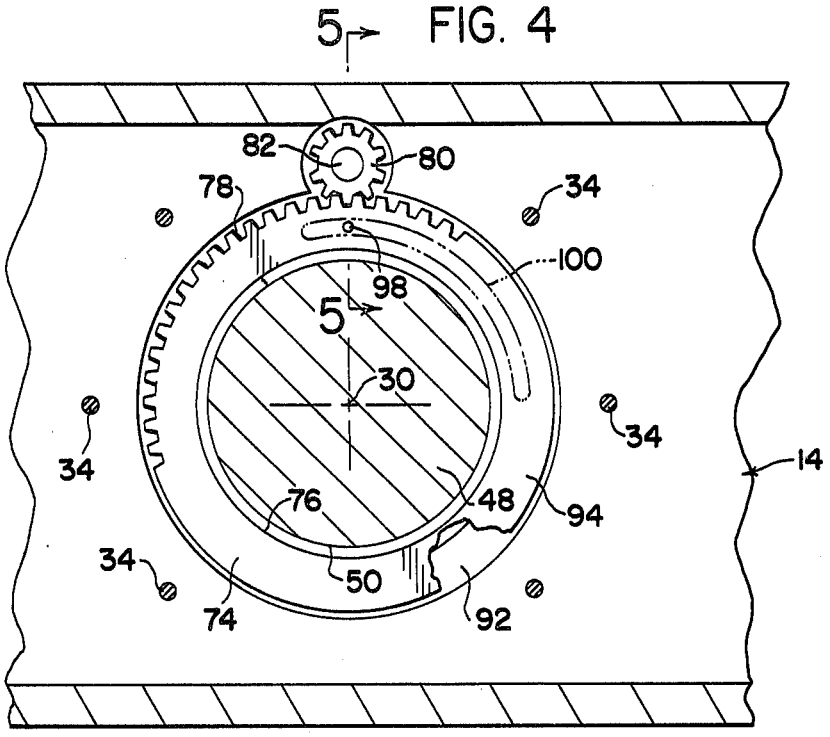
FIG. 4 is a cross-sectional view of the mechanism taken along line 4—4 in FIG. 2; and, FIG. 5 is a sectional elevation view of the mechanism taken along line 5—5 in FIG. 4.

In accordance with the present invention, slide 14 is adjustably interconnected with connecting rod 22 to enable adjusting the shut height of slide 14 or, in other words, the distance between slide 14 and press bed 16 when the slide is in its lowermost or bottom dead center position. In this respect, as best seen in FIGS. 2–4 of the drawing, slide 14 has an axis 30 and includes an annular adjustment barrel member 32 which is coaxial with slide axis 30. In the embodiment shown, barrel member 32 is in the form of a sleeve attached to the slide such as by bolts 34. Accordingly, it will be appreciated that barrel member 32 is fixed to the slide and in effect is a portion of the slide. Slide 14 includes a recess 36 coaxial with slide axis 30, and barrel member 32 and recess 36 receive a slide adjusting screw member 38 which is coaxial with the slide axis. Adjusting screw member 38 has an upper end 40 disposed within the upper portion of barrel member 32 and provided with axially extending external gear teeth 42 for the purpose set forth hereinafter. Barrel member 32 has a lower portion 44 provided internally with butress threads 46 to define a threaded passageway receiving lower portion 48 of adjusting screw member 38 which is provided with external butress threads 50. Threads 50 on adjusting screw 38 matingly engage threads 46 of barrel member 32 for the purpose set forth hereinafter.

In the embodiment shown, the lower end of connecting rod 22 is provided with a ball 52, and the upper end of adjusting screw member 38 is axially recessed to receive socket forming components for ball 52. In this respect, the recessed upper end of adjusting screw member 38 receives and supports a lower ball block 54 and an upper ball cap 56, which block and cap members are retained in assembled relationship with ball 52 by means of a retaining ring 38 attached to the upper end of adjusting screw member 38 by means of a plurality of bolts 60. It will be appreciated of course that the ball block and ball cap members are contoured for mating engagement with ball 52 to swivelly interconnect connecting rod 22 and slide 14. Thus, adjusting screw member 38 is adapted to rotate relative to slide 14 through the threaded interconnection between screw member 38 and barrel member 32 and is adapted to rotate relative to connecting rod 22 through the ball and socket connection. While ball 52 is shown as being on the end of connecting rod 22, it will be appreciated that the ball could be fixed to adjusting screw member 38 or could be an integral part thereof. In such case the connecting rod would carry the socket portion of the connection, thus enabling rotation of the adjusting screw relative to the slide and connecting rod as in the preferred arrangement shown.

It will be appreciated of course that slide 14 and connecting rod 22 are restrained against rotation about slide axis 30 by their respective interengagements with the press frame and crankshaft. It will be further appreciated that adjusting screw member 38 is axially fixed with respect to connecting rod 22 by the ball and socket interconnection therebetween. Accordingly, rotation of adjusting screw member 38 relative to the slide and connecting rod about slide axis 30 rotates threads 50 of the adjusting screw member relative to threads 46 on barrel member 32, thus causing axial displacement of slide 14 relative to connecting rod 22. Rotation of adjusting screw member 38 can be achieved in any desired manner. In the embodiment shown, rotation is achieved by means including a slide adjusting gear 62 which is mounted on the upper end of adjustment barrel member 32 such as by means of a pin 64 for rotation about an axis parallel to slide axis 30. Gear 62 includes an upper worm wheel portion 66 and a lower pinion portion 68 having axially extending teeth 70 in meshing engagement with external teeth 42 on adjusting screw member 38. Gear 62 is adapted to be rotated about its axis and relative to barrel member 32 by a worm gear 72 supported by the slide for rotation about an axis perpendicular to pin 64. Worm gear 72 can be rotated in any suitable manner. For example, the worm gear could be rotated by a motor carried on the slide, or manually such as by a crank.

Slide adjusting gear 62 is axially fixed on barrel member 32 and thus is axially displaced with the slide, and external gear teeth 42 on the upper end of adjusting screw member 38 slide axially relative to teeth 70 on pinion gear portion 68 of gear 62 during relative axial displacement between slide 14 and connecting rod 22. The lineal extent of axial adjustment available between the slide and connecting rod is of course determined by the axial length of gear teeth 42 and the axial length of threads 50 on adjusting screw member 38.

When the slide has been adjusted relative to the connecting rod by rotation of adjusting screw member 38 to achieve a desired shut height for the slide relative to the press bed, it is desirable to lock the adjusting components against relative displacement during subsequent operation of the slide in order to maintain the desired shut height for the slide. In accordance with the present invention such locking is achieved by means of a locking nut 74 coaxial with and surrounding adjusting screw member 38 and located in a circumferential recess provided therefor in the slide. Locking nut 74 has internal butress threads 76 matingly interengaging exterior threads 50 on adjusting screw member 38. Further, the locking nut is provided with external axially extending gear teeth 78 in meshing engagement with the external teeth of a locking pinion 80 mounted on the slide for rotation about an axis parallel to slide axis 30. More particularly, pinion 80 is mounted on the upper end of a pinion shaft 82 which is rotatably supported by the slide and which has a lower end 84 provided with wrench flats for turning the shaft. Shaft 82 is externally threaded adjacent end 84 to receive a jam nut 86 which engages against a shoulder 88 on the press slide to lock shaft 84 against rotation.

The circumferential recess in the slide which receives locking nut 74 has axially opposed upper and lower walls defined by surfaces 90 and 92, respectively. Upper surface 90 of the recess is provided by the barrel member portion of the slide, and surfaces 90 and 92 are spaced apart a distance slightly greater than the thickness of the locking nut as defined by the planar upper and lower sides 94 and 96 thereof. Nut surface 94 and surface 90 of barrel member 32 define axially opposed abutment surfaces on the nut and slide, respectively, and as will be described more fully hereinafter these surfaces are cooperable to lock the adjusting mechanism in a given position of slide adjustment. The locking nut is rotatable in one direction relative to adjusting screw 38 to tightly interengage surfaces 90 and 94 and is rotatable in the opposite direction to axially displace upper side 94 of the locking nut from surface 90. When the nut is rotated in the latter direction adjusting screw 38 is freed for rotation relative to barrel member 32 and locking nut 74.

Figure 5:
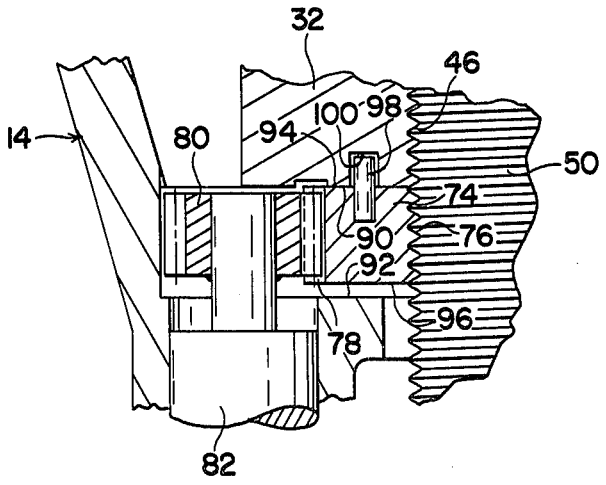

To assure proper thread clearance for relative rotation between adjusting screw 38 and locking nut 74, the slide and locking nut are preferably provided with an interengaging arrangement to limit rotation of the locking nut in the direction of release. In the embodiment disclosed, as best seen in FIGS. 4 and 5, such an interengaging arrangement is achieved by providing locking nut 74 with a pin 98 projecting from upper side 94 thereof and into an arcuate circumferentially extending recess 100 in barrel member 32. Pin 98 and recess 100 are positionally associated with one another such that rotation of locking nut 74 in the direction to displace upper side 94 thereof from surface 90 is stopped by engagement of the pin with one end of recess 100 when the locking nut is in a rotational position which enables adjusting screw 38 to freely rotate relative thereto. It will be appreciated, of course, that the pin could be on barrel member 32 and the slot provided in locking nut 74.

In order to change the shut height of the slide from a given position in which the locking nut is in the locked position thereof, jam nut 86 is rotated to release shaft 82 for rotation, and a suitable wrench is employed to rotate shaft 82 and thus pinion 80 in the direction to rotate locking nut 74 to displace upper side 94 thereof from surface 90 of barrel member 32. When locking nut 74 has been rotated to a position which provides the necessary thread clearance between threads 76 thereof and threads 50 of adjusting screw member 38, pin 98 and recess 100 interengage to stop further rotation of the locking nut. Adjusting screw 38 is then rotated by means of gear 62 in the manner described hereinabove to adjust the slide upwardly or downwardly relative to connecting rod 22. During such rotation of adjusting screw member 38, locking nut 74 is held against rotation by pinion 80, whereby adjusting screw 38 freely rotates relative to the locking nut. When the slide has been displaced to the new position, pinion 80 is rotated by means of shaft 82 to rotate locking nut 74 in the direction to displace upper side 94 thereof tightly against surface 90 of barrel member 32. Pinion 80 enables the application of a high torque to the locking nut, and by tight engagement between locking nut surface 94 and surface 90 of barrel member 32 the adjusting screw 38 is pre-loaded in the direction of the driving force of the slide. All backlash and thread clearances between adjusting screw 38 and threads 46 on barrel member 32 are removed and locked out by such interengagement between surfaces 90 and 94, and are maintained locked out by tightening jam nut 86 against slide surface 88 to lock pinion 80 against rotation.

While particular emphasis has been placed on the preferred embodiment of the invention herein illustrated and described, it will be appreciated that many changes can be made in the preferred embodiment without departing from the principles of the present invention. Accordingly, it is to be distinctly understood that the foregoing descriptive matter is to be interpreted merely as illustrative of the invention and not as a limitation.

Having thus described the invention, it is claimed:

1. A press comprising a frame, means on said frame providing a bed, slide means supported by said frame for reciprocation toward and away from said bed along a slide axis, means to reciprocate said slide means including a connecting rod, an externally threaded rotatable slide adjusting member coaxial with said slide axis, means rotatably and pivotally interconnecting said connecting rod and said slide adjusting member, said slide means including a threaded passageway coaxial with said slide axis and threadedly receiving said slide adjusting member for rotation of said slide adjusting member relative to said slide means to displace said slide means axially relative to said connecting rod, means for rotating said slide adjusting member, internally threaded locking nut means rotatably supported on said slide means coaxial with said slide axis and threadedly receiving said slide adjusting member, said locking nut means and said slide means including axially opposed abutment surfaces, and said locking nut means being rotatable relative to said slide means and to said slide adjusting member to displace said abutment surface of said locking nut means against said abutment surface of said slide means to force said slide means axially of said adjusting member in the direction away from said bed and to releaseably lock said slide adjustment member against rotation relative to said slide means.

2. The press according to claim 1, wherein said slide means includes means providing a recess coaxial with said slide axis, said recess including axially opposed walls, said locking nut means including axially opposed sides in said recess between said opposed walls of said recess, one of said walls and the adjacent one of said sides defining said abutment surfaces of said slide means and locking nut means, and said opposed sides of said nut means being axially spaced apart a distance less than the spacing between said opposed walls.

3. The press according to claim 1, and means to rotate said locking nut means in opposite directions relative to said slide means.

4. The press according to claim 3, wherein rotation of said locking nut means in one of said opposite directions displaces said abutment surface of said locking nut means toward said abutment surface of said slide means, and means to limit rotation of said locking nut means in the other of said opposite directions to position said thread means of said locking nut means to permit rotation of said slide adjusting member relative to said slide means and said locking nut means.

5. The press according to claim 1, wherein said locking nut means is an externally toothed ring, and means to rotate said ring in opposite directions including a pinion rotatably mounted on said slide in meshing engagement with said toothed ring and means to rotate said pinion.

6. The press according to claim 5, and means to lock said pinion against rotation.

7. The press according to claim 5, wherein rotation of said ring in one of said opposite directions displaces said abutment surface of said locking nut means toward said abutment surface of said slide means, and means to limit rotation of said ring in the other of said opposite directions to position said thread means of said locking nut means to permit rotation of said slide adjusting member relative to said slide means and said locking nut means.

8. The press according to claim 7, wherein said slide means includes means providing a recess coaxial with said slide axis, said recess including axially opposed walls, said locking nut means including axially opposed sides in said recess between said opposed walls of said recess, one of said walls and the adjacent one of said sides defining said abutment surfaces of said slide means and said locking nut means and said opposed sides of said nut means being axially spaced apart a distance less than the spacing between said opposed walls.

9. The press according to claim 8, wherein said axially opposed walls of said recess and said axially opposed sides of said locking nut means are upper and lower walls and sides with respect to the direction of movement of said slide means toward said bed, said upper wall of said recess being said one wall and said upper side of said locking nut means being said adjacent one of said sides.

10. The press according to claim 8, wherein said slide adjusting member includes gear teeth externally thereof, and said means to rotate said slide adjusting member includes a second pinion rotatably mounted on said slide means in meshing relationship with said gear teeth on said slide adjusting member, and means to rotate said second pinion.

11. A press comprising a frame, means on said frame providing a bed, a slide supported by said frame for reciprocation toward and away from said bed along a slide axis, means to reciprocate said slide including a connecting rod having a ball on one end thereof, a slide adjusting member, socket means swivelly interconnecting said ball and said slide adjusting member, said slide adjusting member having an axis coaxial with said slide axis and axially adjacent upper and lower outer surface portions with respect to the direction from said slide toward said bed, said lower outer surface portion of said slide adjusting member being threaded, said slide including an internally threaded passageway coaxial with said slide axis and matingly interengaging with said threaded lower end of said slide adjusting member for rotation of said slide adjusting member relative to said slide to displace said slide axially relative to said rod end, said upper outer surface portion of said slide adjusting member being provided with gear teeth, a first pinion in meshing engagement with said gear teeth and mounted on said slide for rotation relative thereto to rotate said slide adjusting member relative to said slide, means to rotate said first pinion, said slide further including a circumferential recess coaxial with said slide axis below said passageway, said recess surrounding said lower outer surface portion of said slide adjusting member and opening radially inwardly theretoward, an annular locking nut in said recess and having internal threads matingly interengaging said threaded lower end of said slide adjusting member, said recess having axially opposed upper and lower walls and said locking nut having axially opposed upper and lower surfaces axially spaced apart a distance less than the distance between said walls, said locking nut being rotatable relative to said slide and said slide adjusting member to displace said upper surface of said locking nut against said upper wall of said recess to releaseably lock said slide adjusting member against rotation relative to said slide, and means to rotate said locking nut.

12. The press according to claim 11, wherein said annular locking nut has external gear teeth thereon and said means to rotate said locking nut includes a second pinion in meshing engagement with said gear teeth on said locking nut and mounted on said slide for rotation relative thereto, and means to rotate said second pinion in opposite directions relative to said slide.

13. The press according to claim 12, and means to lock said second pinion against rotation relative to said slide.

14. The press according to claim 12, wherein rotation of said second pinion in one of said opposite directions rotates said locking nut in the direction to displace said upper surface of said locking nut from said upper wall of said recess to free said slide adjusting member for rotation relative to said slide, and means to limit rotation of said locking nut in said one of said opposite directions.

15. The press according to claim 14, and means to lock said second pinion against rotation relative to said slide.

16. The press according to claim 14, wherein said means to limit rotation of said locking nut includes a pin on said locking nut and recess in said slide receiving said pin and having an end engaged by said pin upon rotation of said locking nut in said one of said opposite directions.

* * * * *